US006808009B2

(12) United States Patent
Anderson

(10) Patent No.: US 6,808,009 B2
(45) Date of Patent: Oct. 26, 2004

(54) SYSTEM FOR PROVIDING CONSISTENT FLOW THROUGH MULTIPLE PERMEABLE PERIMETER WALLS IN A CASTING MOLD

(75) Inventor: Michael K. Anderson, Otis Orchards, WA (US)

(73) Assignee: Alcan International Limited, Montreal (CA)

( * ) Notice: Subject to any disclaimer, the term of this patent is extended or adjusted under 35 U.S.C. 154(b) by 75 days.

(21) Appl. No.: 10/461,631

(22) Filed: Jun. 12, 2003

(65) Prior Publication Data

US 2003/0213577 A1 Nov. 20, 2003

Related U.S. Application Data

(62) Division of application No. 09/620,110, filed on Jul. 20, 1997, now Pat. No. 6,609,557, which is a continuation of application No. 08/891,019, filed on Jul. 10, 1997, now abandoned.

(51) Int. Cl.[7] ..... B22D 11/00

(52) U.S. Cl. ..... 164/459; 164/418; 164/444; 164/487; 164/472; 164/268

(58) Field of Search ..... 164/459, 418, 164/444, 487, 472, 268, 137, 341

(56) References Cited

U.S. PATENT DOCUMENTS

| | | | | |
|---|---|---|---|---|
| 4,653,571 A | | 3/1987 | Suzuki et al. | |
| 4,930,566 A | | 6/1990 | Yanagimoto et al. | 164/475 |
| 5,033,535 A | | 7/1991 | LeBlanc et al. | 164/472 |
| 5,325,910 A | | 7/1994 | Schneider et al. | 164/472 |
| 6,158,498 A | | 12/2000 | Wagstaff | |
| 6,260,602 B1 | | 7/2001 | Wagstaff | |
| 6,546,995 B1 | | 4/2003 | Wagstaff | |
| 6,609,557 B1 | * | 8/2003 | Anderson | 164/459 |

FOREIGN PATENT DOCUMENTS

| | | |
|---|---|---|
| WO | WO 99/20418 | 4/1999 |
| WO | WO 01/00352 | 1/2001 |

* cited by examiner

*Primary Examiner*—Kiley Stoner
*Assistant Examiner*—I.-H. Lin
(74) *Attorney, Agent, or Firm*—Cooper & Dunham LLP

(57) ABSTRACT

Disclosed is a system for providing consistent lubricant and/or gas flow through multiple permeable perimeter walls in a casting mold table. One or more of the properties of the perimeter walls indicative of the lubricant flow or gas flow rates through the perimeter walls are predetermined and the sizing of the surface area of the delivery conduits providing the lubricant or the gas are determined based on a correlation to the properties related to the measured or estimated lubricant flow rate and/or measured or estimated gas flow rates through the perimeter walls.

16 Claims, 10 Drawing Sheets

SYSTEM FOR PROVIDING CONSISTENT FLOW THROUGH MULTIPLE PERMEABLE PERIMETER WALLS IN A CASTING MOLD

CROSS REFERENCE TO RELATED APPLICATIONS

This application is a division of U.S. patent application Ser. No. 09/620,110, filed Jul. 20, 1997 now U.S. Pat. No. 6,609,557 which is a continuation of application Ser. No. 08/891,019, filed Jul. 10, 1997.

TECHNICAL FIELD

This invention pertains to a system for providing consistent lubricant and/or gas flow through multiple permeable perimeter walls in a metal casting mold table.

BACKGROUND OF THE INVENTION

Metal ingots and billets are typically formed by a casting process, which utilizes a vertically oriented mold situated above a large casting pit beneath the floor level of the metal casting facility. The lower component of the vertical casting mold is a starting block mounted on starting block pedestals. When the casting process begins, the starting blocks are in their upward-most position and in the molds. As molten non-ferrous metal is poured into the mold and cooled, the starting block is slowly lowered at a pre-determined rate by a hydraulic cylinder or other device. As the starting block is lowered, solidified non-ferrous metal or aluminum emerges from the bottom of the mold and ingots or billets are formed.

While the invention applies to casting of metals in general, including without limitations aluminum, brass, lead, zinc, magnesium, copper, steel, etc., the examples given and preferred embodiment disclosed are for aluminum, and therefore the term aluminum will be used throughout for consistency even though the invention applies more generally to metals.

While there are numerous ways to achieve and configure a vertical casting arrangement, FIG. 1 illustrates one example. In FIG. 1, the vertical casting of aluminum generally occurs beneath the elevation level of the factory floor in a casting pit. Directly beneath the casting pit floor 1*a* is a caisson 3, in which the hydraulic cylinder barrel 2 for the hydraulic cylinder is placed.

As shown in FIG. 1, the components of the lower portion of a typical vertical aluminum casting apparatus, shown within a casting pit 1 and a caisson 3, are a hydraulic cylinder barrel 2, a ram 6, a mounting base housing 5, a platen 7 and a starting block base 8, all shown at elevations below the casting facility floor 4.

The mounting base housing 5 is mounted to the floor 1*a* of the casting pit 1, below which is the caisson 3. The caisson 3 is defined by its side walls 3*b* and its floor 3*a*.

A typical mold table assembly 10 is also shown in FIG. 1, which can be tilted as shown by hydraulic cylinder 11 pushing mold table tilt arm 10*a* such that it pivots about point 12 and thereby raises and rotates the main casting frame assembly, as shown in FIG. 1. There are also mold table carriages which allow the mold table assemblies to be moved to and from the casting position above the casting pit.

FIG. 1 further shows the platen 7 and starting block base 8 partially descended into the casting pit 1 with billet 13 being partially formed. Billet 13 is on starting block 14, which is mounted on pedestal 15. While the term starting block is used for item 14, it should be noted that the terms bottom block and starting head are also used in the industry to refer to item 14, bottom block typically used when an ingot is being cast and starting head when a billet is being cast.

While the starting block base 8 in FIG. 1 only shows one starting block 14 and pedestal 15, there are typically several of each mounted on each starting block base, which simultaneously cast billets or ingots as the starting block is lowered during the casting process.

When hydraulic fluid is introduced into the hydraulic cylinder at sufficient pressure, the ram 6, and consequently the starting block base 8, are raised to the desired elevation start level for the casting process, which is when the starting blocks are within the mold table assembly 10.

The lowering of the starting block base 8 is accomplished by metering the hydraulic fluid from the cylinder at a pre-determined rate, thereby lowering the ram 6 and consequently the starting blocks at a pre-determined and controlled rate. The mold is controllably cooled during the process to assist in the solidification of the emerging ingots or billets, typically using water cooling means.

There are numerous mold and pour technologies that fit into these mold tables. Some are generally referred to as "hot top" technology, while others are more conventional casting technologies that use floats and downspouts, both of which are known to those of ordinary skill in the art. The hot top technology generally includes a refractory system and molten metal trough system located on top of the mold table, whereas the conventional pour technology involves suspending or supporting the source of molten metal above the mold table and the utilization of down spouts or tubes and floats to maintain the level of molten metal in the molds while also providing molten metal to the molds.

These different casting technologies have different advantages and disadvantages and produce various billet qualities, but no one of which is required to practice this invention.

The metal distribution system is also an important part of the casting system. In the two technology examples given, the hot top distribution trough sits atop the mold table while the conventional pouring trough is suspended above the mold table to distribute the molten metal to the molds.

Mold tables come in all sizes and configurations because there are numerous and differently sized and configured casting pits over which mold table are placed. The needs and requirements for a mold table to fit a particular application therefore depends on numerous factors, some of which include the dimensions of the casting pit, the location(s) of the sources of water and the practices of the entity operating the pit.

The upper side of the typical mold table operatively connects to, or interacts with, the metal distribution system. The typical mold table also operatively connects to the molds which it houses.

The use of a permeable or porous perimeter wall has proven to be an effective and efficient way to distribute lubricant and gas to the inside surface of a continuous casting mold, such as is described in U.S. Pat. No. 4,598,763 to Wagstaff.

In the typical use of a permeable perimeter wall, lubricant and gas are delivered to the perimeter wall under pressure through grooves or delivery conduits around the perimeter wall, typically using one delivery conduit (if grooves are used for the delivery of lubricant) and one or two delivery conduits (grooves) for the delivery of gas. The preferred lubricants are synthetic oils, whereas the current preferred gas is air. The lubricant and gas then permeate through the perimeter wall and are delivered to the interior of the mold as part of the casting process.

The perimeter walls on existing mold tables each have delivery conduits to deliver the lubricant and/or gas, and the delivery conduits may be circumferential groove-shaped delivery conduits with the same depth and width, or they may be holes partially drilled through the perimeter walls, or any other delivery means for that matter. The typical perimeter wall has a separate lubricant delivery conduit and a gas conduit.

Graphite has proven to be the preferred permeable material for use as the perimeter wall material or media. However, graphite has proven to be expensive in consistently producing high quality individual products which have very similar permeability to other graphite perimeter walls.

One of the significant factors causing the high cost incurred in providing consistent permeability or lubricant/gas flow rates through the perimeter walls is the variability in the relevant properties of the perimeter wall material. The properties related to the lubricant and gas flow rates can vary significantly from batch to batch of graphite for instance, and even within the same batch and within a given perimeter wall. Variations in properties such as porosity, permeability and density, impact the rate of delivery of lubricant and or gas through the perimeter wall. Furthermore, the viscosity of a particular lubricant or gas as well as the pressure at which the lubricant or gas is supplied to the perimeter wall, are factors affecting the respective flow rates through the permeable perimeter walls.

Experience has taught that graphite from a particular supplier or source will tend to have more similar properties than graphite from two different sources or suppliers, however, there may still be unacceptable variations in the properties of the graphite from a single source and even from a single batch. This is the case even though a particular density is typically specified when ordering.

In a typical application, one perimeter wall is used for each mold, and there are typically numerous molds on a single mold table, each mold having a perimeter wall. It is preferred to supply gas from one source line at one pressure and to supply lubricant from one source line at one pressure, to all perimeter walls in molds of a particular mold table.

The variations of most concern in the lubricant and/or gas flow rates through the graphite are therefore based on the variability in the properties of the graphite related to the respective flow rates, which becomes the critical factor in accomplishing the goal of the equal or predictable flow rates of lubricant and gas through the perimeter walls in each of the molds on the same mold table, or even in the same manufacturing facility.

Prior to this invention, achieving the same flow rate or delivery rate of lubricant and/or gas flow through multiple perimeter walls on the same mold table, was very time consuming and expensive, and resulted in significant waste. Each individual perimeter wall was extensively tested to determine its properties relevant to flow rate and an unnecessarily large percentage were rejected due to the flow rate variations.

With numerous molds on the same table simultaneously casting metal, it becomes critical to achieving a reliable process for producing high quality molded products (billet, ingot or special shapes) that the lubricant and/or gas delivered to the perimeter walls during casting is very closely the same from perimeter wall to perimeter wall in the same mold table.

In order to achieve consistent lubricant and/or gas flow rates through the perimeter walls in each of the molds in a given mold table, a high rate of rejection of graphite rings has been experienced. Typically, graphite perimeter walls with similar properties may be grouped together to achieve closely similar lubricant and/or gas flow rates. However, while grouping perimeter walls together may work for new construction, managing the selective replacement of perimeter walls in place in a facility can be very difficult.

From a practical and expense perspective, lubricant and/or gas are supplied at a constant pressure, and the perimeter walls are manufactured at a constant or fixed thickness and general size to fit within the molds. The inner and outer diameters of the perimeter walls, as well as their overall height also is generally fixed.

It is an objective of this invention to achieve a sufficiently consistent lubricant and/or gas flow rate through multiple perimeter walls on a mold table or in a casting facility, even though the perimeter walls generally have variations in their individual properties related to the flow rate of lubricant and/or gas through the perimeter wall body.

It is also an objective of this invention to reduce the significant expense of a high rejection rate for perimeter walls to achieve the sufficiently consistent lubricant and/or gas flow rate.

This invention accomplishes these objectives by providing a system for providing consistent lubricant and/or gas flow through multiple permeable perimeter walls. The system involves ascertaining one or more of the relevant properties, or the actual flow rate, of the perimeter walls, and then determining and creating the appropriate surface area of the delivery conduit which provides the lubricant and/or gas to the exterior of the perimeter wall, and/or the appropriate delivery distance.

The system provided by this invention has the significant advantage of allowing the use of multiple perimeter walls with different flow related properties, or with different lubricant and/or gas flow rates, to be used in the same mold table, while achieving consistent flow rates through each perimeter wall.

The system provided by this invention has the significant advantage of providing a significantly similar flow rate of lubricant or gas in a plurality of perimeter walls in molds on the same mold table.

In accomplishing these objectives, this invention provides a system which is simpler and less expensive than all prior systems.

BRIEF DESCRIPTION OF THE DRAWINGS

Preferred embodiments of the invention are described below with reference to the accompanying drawings, which are briefly described below.

FIG. 6 is a top view of the perimeter wall illustrated in FIG. 5;

FIG. 9 is a top view of an alternative embodiment of a perimeter wall contemplated by this invention, wherein lubricant and/or gas are delivered to the perimeter wall through holes drilled from the top of the perimeter wall;

FIG. 12 is a top partial view of a perimeter wall which illustrates the movement of the location of the delivery holes to affect the flow rates.

DETAILED DESCRIPTION OF THE PREFERRED EMBODIMENTS

Figure 1:
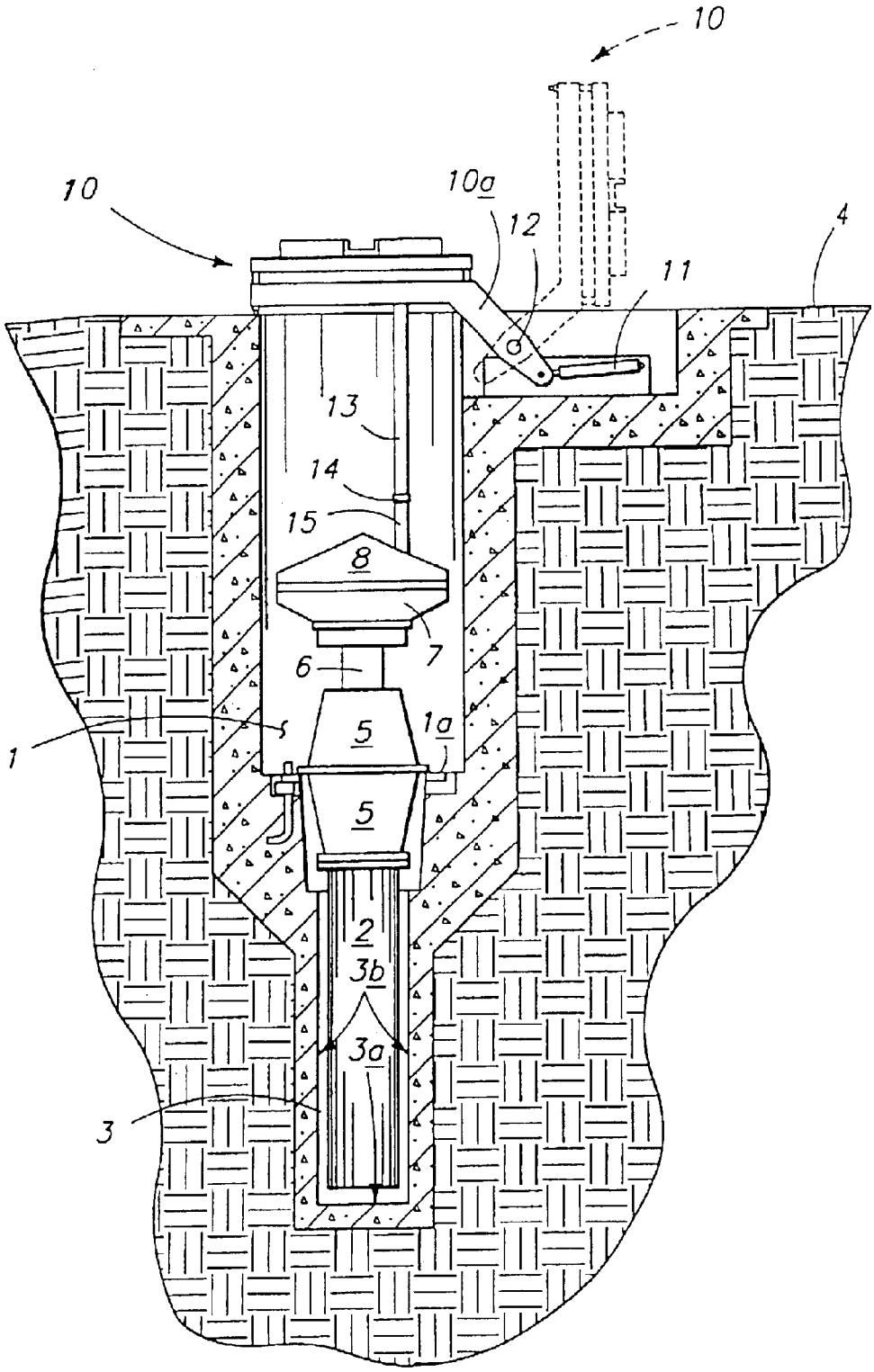
FIG. 1 is an elevation view of a typical casting pit, caisson and aluminum casting apparatus.

This disclosure of the invention is submitted in furtherance of the constitutional purposes of the U.S. Patent Laws "to promote the progress of science and useful arts" (Article 1, Section 8).

Many of the fastening, connection, process and other means and components utilized in this invention are widely known and used in the field of the invention described, and their exact nature or type is not necessary for an understanding and use of the invention by a person skilled in the art or science, and they will not therefore be discussed in significant detail. Furthermore, the various components shown or described herein for any specific application of this invention can be varied or altered as anticipated by this invention and the practice of a specific application of any element may already be widely known or used in the art or by persons skilled in the art or science and each will not therefore be discussed in significant detail.

It is to be understood that this invention applies to and can be utilized in connection with various types of metal casting and pour technologies and configurations, including but not limited to both hot top technology and conventional pour technology. It is further to be understood that this invention may be used on horizontal or vertical casting devices.

The mold therefore must be able to receive molten metal from a source of molten metal, whatever the particular source type is, whether it be hot top pour technology or a conventional pour apparatus. The mold cavities or inlets in the mold must therefore be oriented in fluid or molten metal receiving position relative to the source of molten metal.

The term mold table as used herein can be any one of a number of different types, and is generally a framework for holding a plurality of molds. Mold tables are generally known to those skilled in the art.

The term circumferential as used herein in reference to the delivery conduits around the perimeter wall, is not limited to a delivery conduit or item which extends around the entire circumference, but instead also includes one which extends partially, but not wholly around the circumference. The delivery conduits may therefore extend around the entire circumference of the perimeter wall.

Furthermore, use of the term around likewise is not limited to something such as a delivery conduit being continuous all the way around the object.

When the term permeable is used herein with permeable perimeter wall body, the entire perimeter wall body does not necessarily have to be permeable, but instead only that portion through which lubricant and/or gas flow is desired.

U.S. Pat. No. 4,598,763, issued to Wagstaff et al. is incorporated herein by this reference.

The preferred perimeter walls contemplated by this invention are generally rigid or solid, but they need not be as they may be semi-rigid or semi-solid within the contemplation of this invention.

It will also be appreciated by those skilled in the art that the perimeter wall contemplated by this invention may be practiced as a one piece perimeter wall, or a plurality of sections placed together to form the perimeter wall. This will be particularly applicable for special shaped molds.

Although graphite has proven to be the preferred permeable or porous material for use as the perimeter wall, this invention is not limited thereto. However, for ease of description, but without limiting the scope of the invention, the term "graphite" may be used herein to describe the material of which the permeable perimeter wall is comprised because is the preferred material.

In an embodiment of the invention wherein the lubricant and/or gas factors such as pressure and viscosity, are desired to be maintained constant, the two main factors in determining the flow rate of the lubricant and/or the gas are the surface area through which they are flowing and the delivery distance, i.e. the distance the lubricant and/or gas must travel to arrive at the desired area, which is the inner surface of the perimeter wall. These are the primary or preferred factors to vary, with the delivery distance being the preferred factor to alter.

The term flow rate as used herein in the claims may include not only the actual or measured flow rate, but also the estimated flow rate.

The depth and height of a lubricant delivery conduit or a gas delivery conduit define a surface area for each. Varying the delivery conduit surface area, or the surface area in general, where the lubricant or the gas is applied, will vary the overall flow rate of the lubricant and/or gas through the perimeter wall. Those skilled in the art will appreciate how changes in the surface area of the delivery conduit will vary the flow rate of lubricant or gas, and how empirical data may be developed for the same.

When the delivery conduit surface area is referred to herein, it is not limited to the surface area of a continuous conduit, but instead includes the sum total surface area of a plurality of such delivery conduits or delivery holes, as the case may be. A delivery conduit as used herein likewise includes one or more delivery holes, the delivery holes may be either transverse to the inner surface of the perimeter wall or longitudinal to the inner surface and within the perimeter wall body, within the contemplation of this invention.

The flow rate of the lubricant or gas may also be varied by increasing or decreasing the height of the cross sectional area to which the lubricant or gas will be applied, which changes the surface area. For example, in the embodiment of the invention wherein the delivery conduits are actually in the mold housing, as illustrated more fully in FIG. 4, increasing the height of a delivery conduit has the effect of increasing the surface area through which lubricant and/or gas may permeate, thereby increasing the overall flow of the lubricant or gas through the perimeter wall.

When it is referred to herein that the surface area of the lubricant delivery conduit or gas delivery conduit is correlated to a pre-determined flow rate of lubricant or gas through the permeable body of the perimeter wall for instance, this is intended to be broadly construed to include direct and indirect measurement, calculation, correlation or estimation of the flow rate through the permeable body, and the sizing of the depth or the height of the lubricant or gas delivery conduit based on that estimate, calculation or measurement. It may further involve varying the thickness of the material or media through which the lubricant and/or gas must travel to be delivered to the desired location at the inner surface of the perimeter wall. It is further intended to include the measurement, calculation or estimation of one or more properties or reflections of the permeable body which may be indicative of the flow rate of the lubricant or gas through the permeable body, and determining the surface area of the lubricant or gas delivery conduit(s) based thereon.

Correlating the surface area of a delivery conduit to a flow characteristic of the material may also involve drilling more delivery conduits to increase the surface area of the "at least one" delivery conduits, or increasing the diameter or inner surface area of the holes.

When it is referred to that the perimeter walls are disposed around each mold cavity, that is intended to mean that the perimeter wall is disposed about that part of the mold cavity wherein it may be used, such as is described in U.S. Pat. No. 4,598,763, which has been previously incorporated herein by reference, or in other locations that those skilled in the art will appreciate. This would typically be at an intermediate location or an exit location of the mold cavity, as further illustrated in FIG. 2.

The term flow characteristic as used herein, means any characteristic of the graphite or other material used for the permeable portion of the perimeter wall body which directly or indirectly affects the flow rate of lubricant and/or gas through it, which includes, but is not limited to: the density of the material; the flow rate of the material; the porosity of the material; and/or the permeability of the material; any factor affecting the foregoing; or any combination of the foregoing.

Although the preferred embodiment utilizes delivery conduits in the perimeter wall itself, this invention is not limited thereto as it also embodies the placement of the delivery conduits in the component immediately adjacent the outer surface of the perimeter wall, which is typically referred to as the mold housing. For purpose of this description, any intermediate components between the perimeter wall and the mold housing will be considered and described as part of the mold housing, such as an intermediate sleeve.

Figure 2:
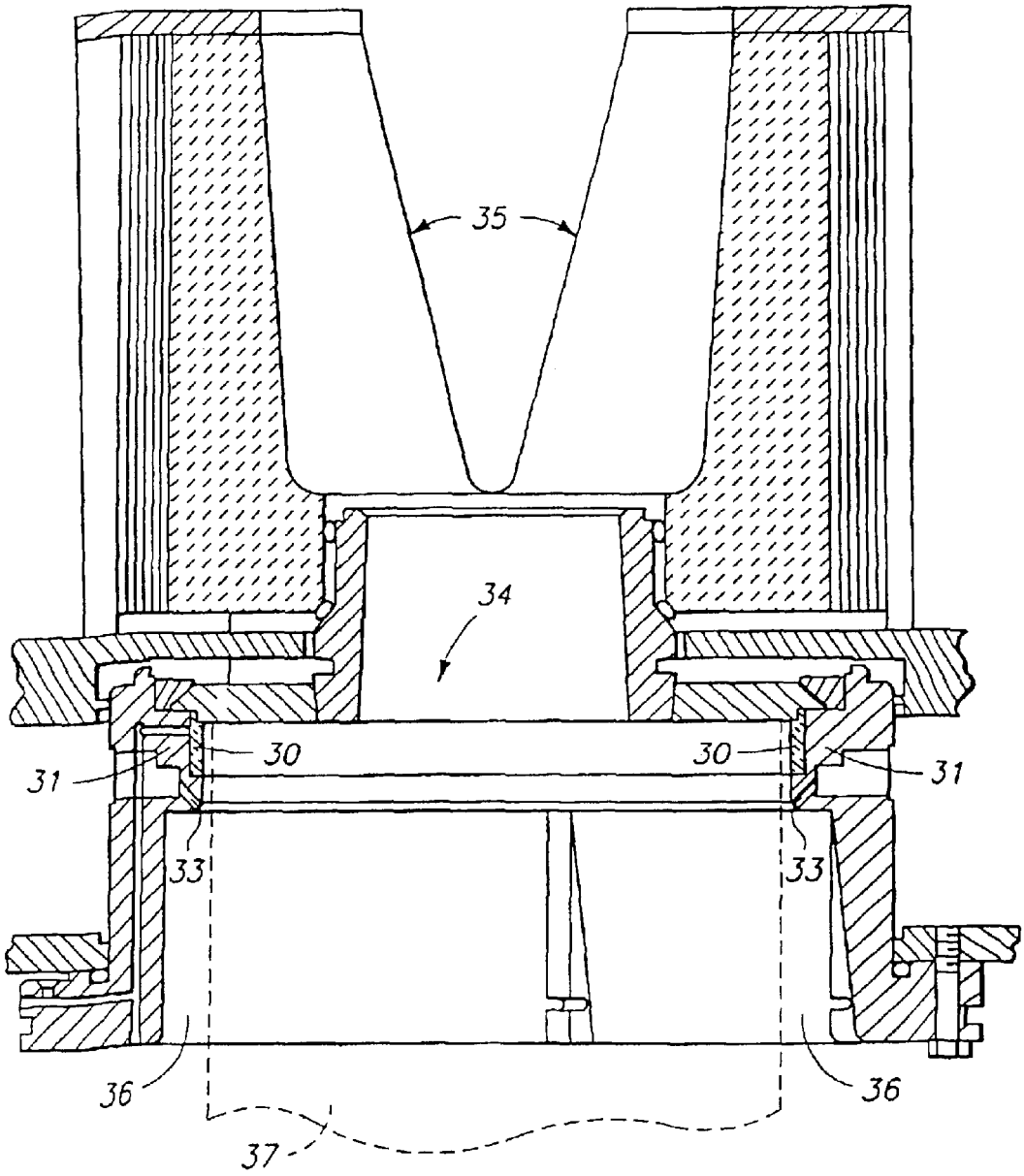
FIG. 2 is a cross sectional elevation view of a typical mold casting assembly, illustrating the perimeter wall in place.

FIG. 2 illustrates a perimeter wall 30 in place in a mold, and abutted against the mold housing 31. The mold housing 31 combined with the lubricant and gas delivery conduits in the perimeter wall form the lubricant and gas passageways through which the lubricant and gas are provided to permeate through the perimeter wall 30. Coolant is introduced to solidify the emerging metal through coolant passageways 33.

FIG. 2 further illustrates the mold inlet 34, the refractory troughs 35 for directing the molten metal to the mold inlet 34. The embodiment in FIG. 2 illustrates an emerging solidified billet 37, and the mold air cavity 36 surrounding the billet 37.

It should be noted that the air cavity 36 is different than what is referred to in the industry as the air gap or air slip. The air gap or air slip is the layer or area of air which occurs between the perimeter wall 30 and the metal passing through the perimeter wall 30 during casting.

Figure 3:
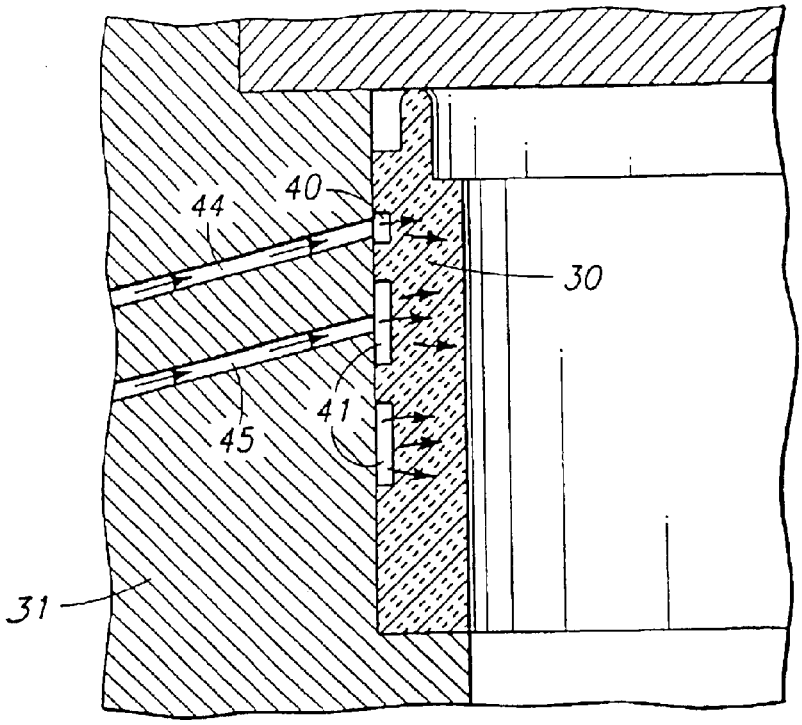
FIG. 3 is a cross sectional view of a perimeter wall seated in a mold housing, illustrating the flow of lubricant or gas through its body.

FIG. 3 is a cross sectional view of an embodiment of a perimeter wall 30 contemplated by this invention, seated in a mold housing 31. The gas inlet line 45 and the lubricant inlet line 44 are also shown, and illustrate how lubricant and gas may be provided to the lubricant delivery conduit 40 and the gas delivery conduits 41.

Figure 4:
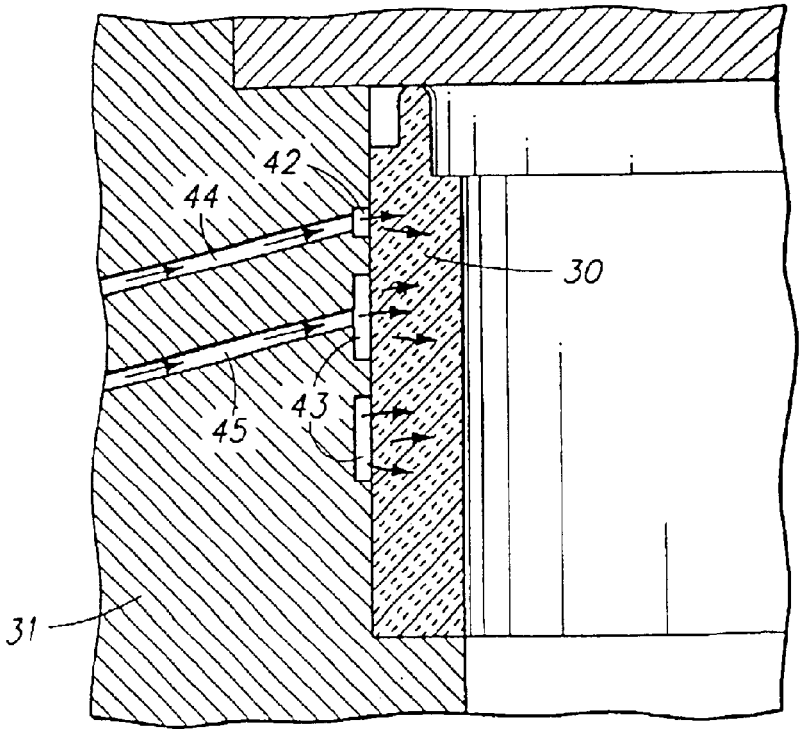
FIG. 4 is a cross sectional view of a perimeter wall seated in a mold housing, illustrating the flow of lubricant or gas through its body, only wherein the delivery conduits are in the mold housing.

FIG. 4 is also a cross sectional view of an embodiment of a perimeter wall 30 contemplated by this invention, seated in a mold housing 31, and further illustrating an embodiment wherein the lubricant delivery conduit 42 and the gas delivery conduits 43 are within the mold housing 31. The gas inlet line 45 and the lubricant inlet line 44 are also shown, and illustrate how lubricant and gas may be provided to the lubricant delivery conduit 42 and the gas delivery conduits 43.

Figure 5:
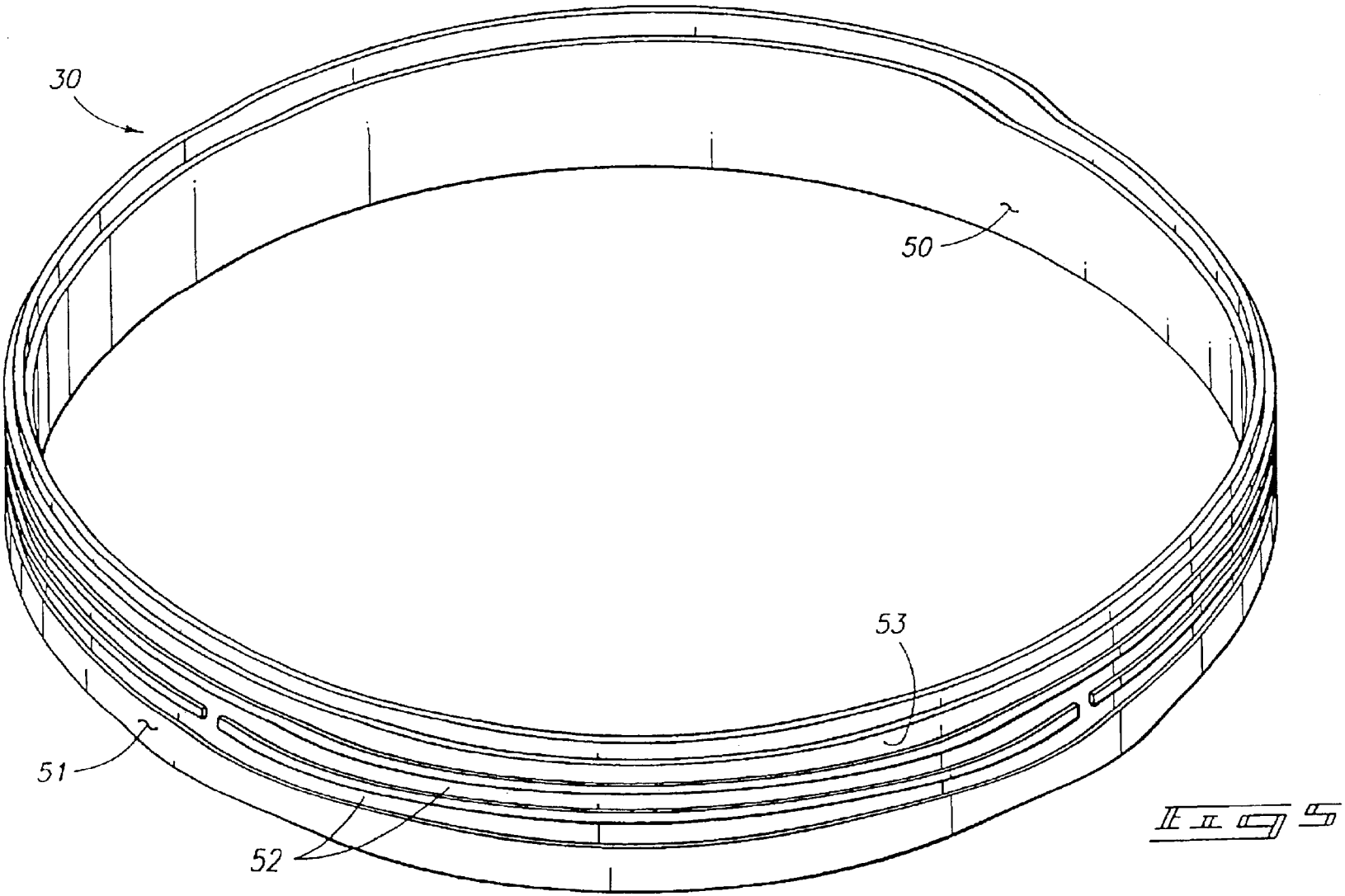
FIG. 5 is a perspective of one embodiment of a perimeter wall which is contemplated for use by this invention.

FIG. 5 is a perspective of one embodiment of a perimeter wall 30 which is contemplated for use by this invention, and illustrates the inner surface 50, the outer surface 51, gas delivery conduits 52 and lubricant delivery conduit 53. The two gas delivery conduits 52 are shown in operative connection to one another.

FIG. 6 is a top view of the perimeter wall 30 illustrated in FIG. 5, also illustrating the inner surface 50 and the outer surface 51.

Figure 7:
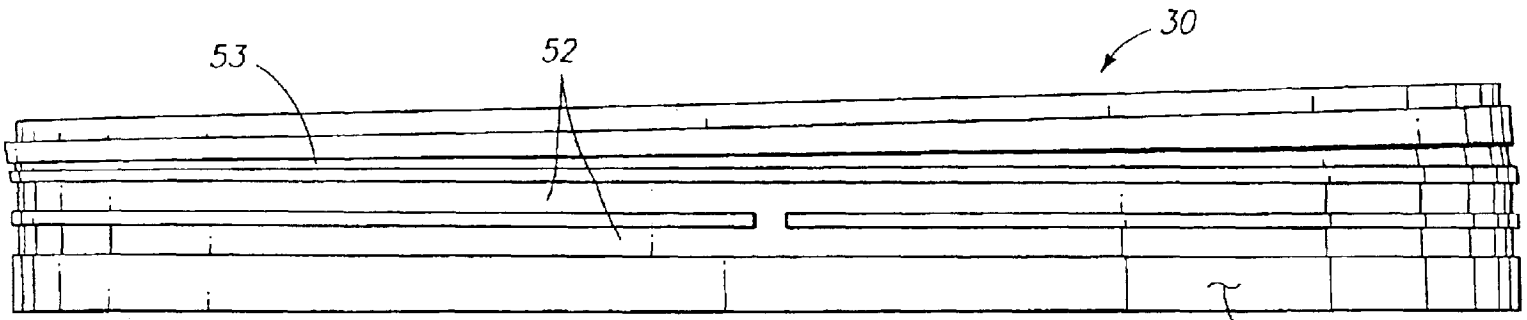
FIG. 7 is an elevation view of the perimeter wall illustrated in FIG. 5.

FIG. 7 is an elevation view of the perimeter wall 30 illustrated in FIG. 5, and illustrates the outer surface 51, gas delivery conduits 52 and lubricant delivery conduit 53.

Figure 8:
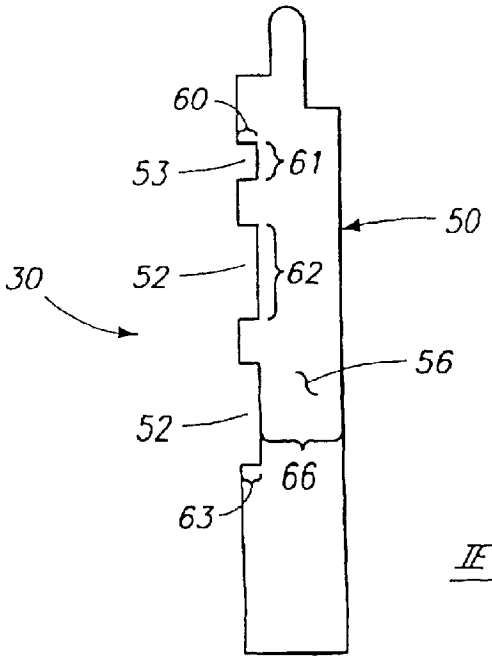
FIG. 8 is Section 8—8 from the perimeter wall illustrated in FIG. 6.
Figure 11:
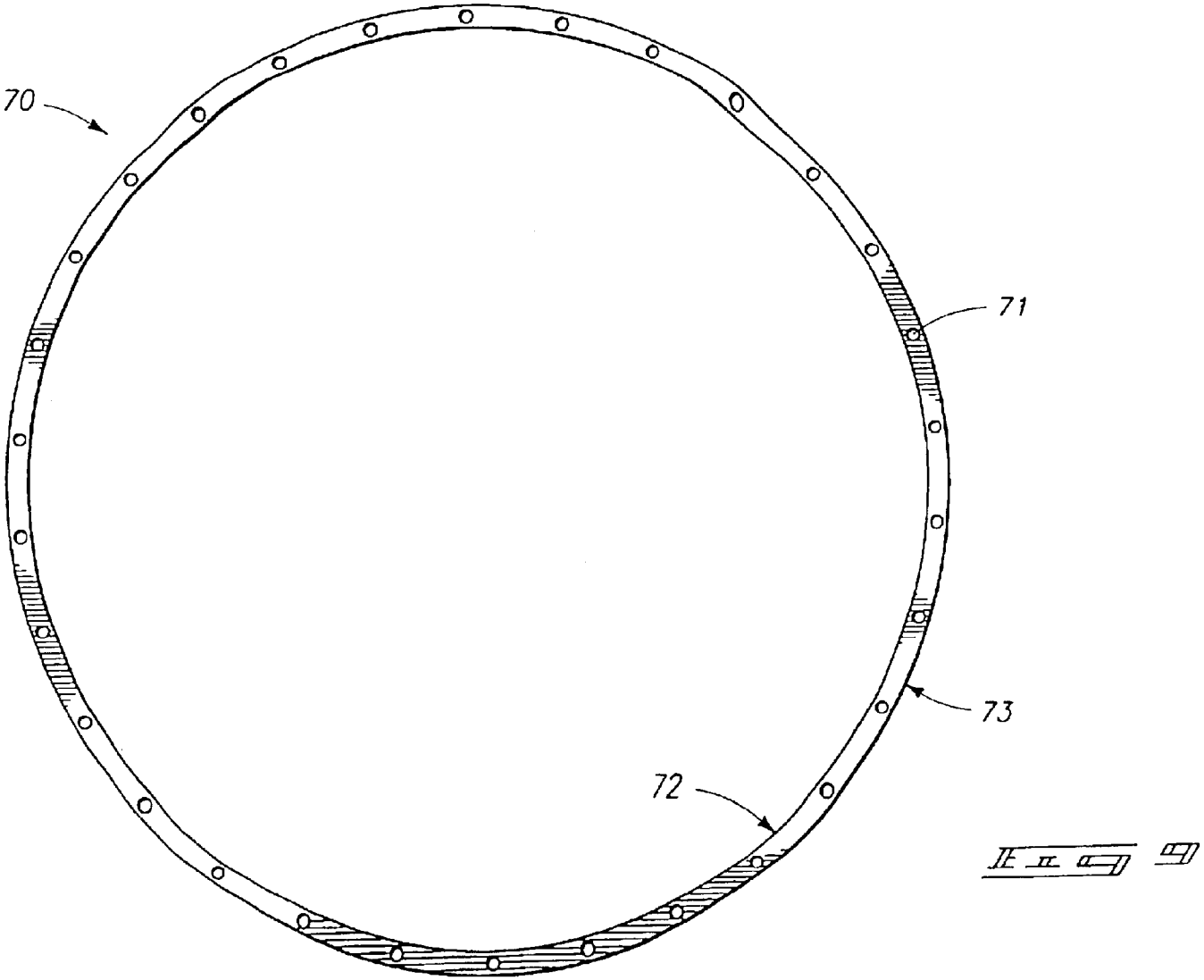

FIG. 8 is Section 8—8 from the perimeter wall illustrated in FIG. 6, and shows the cross section of one embodiment of the invention. FIG. 8 illustrates perimeter wall 30, perimeter wall body 56, lubricant delivery conduit 53, lubricant delivery conduit height 61, lubricant delivery conduit depth 60, gas delivery conduits 52, gas delivery conduit height 62, and gas delivery conduit depth 63.

FIG. 8 further illustrates the delivery distance 66 from the termination of a delivery conduit to the inner surface 50 of the perimeter wall 30.

The delivery distance for any conduit or delivery hole is the distance the lubricant and/or gas must travel to arrive at its desired location at the inner surface of the perimeter wall.

FIG. 9 shows an alternative embodiment of the invention wherein the gas and/or lubricant are delivered to the perimeter wall 70 through delivery holes 71 drilled from the top of the perimeter wall 70, FIG. 9 further shows the outer surface 73 and the inner surface 72 of the perimeter wall 70. The lubricant and/or gas may be delivered to the perimeter wall through a plenum positioned adjacent the perimeter wall 70, or any one of a number of other known means.

Figure 10:
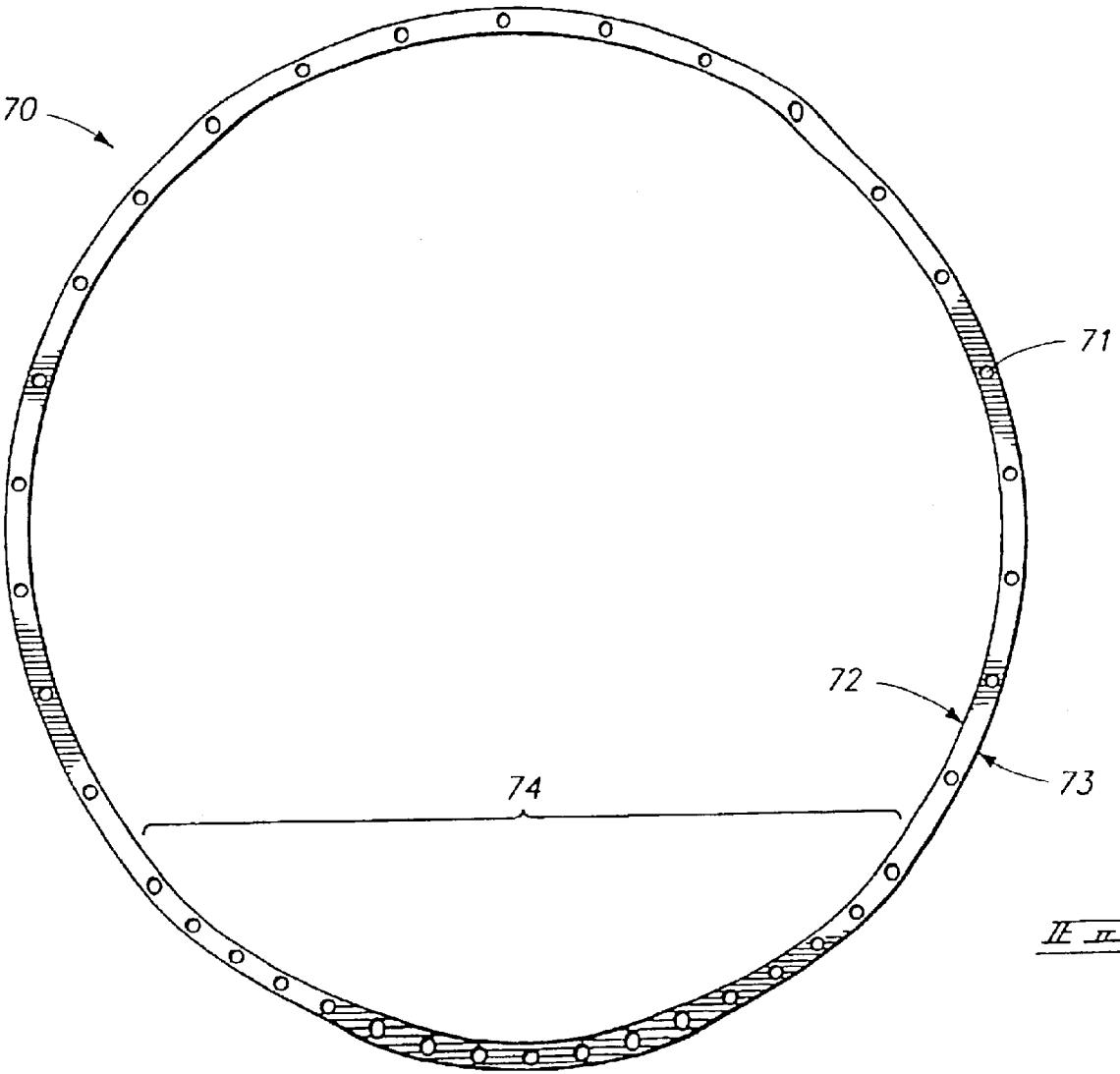
FIG. 10 is a top view of an alternative embodiment in which lubricant and/or gas are delivered to the perimeter wall through holes drilled from the top of the perimeter wall, and wherein the holes through which lubricant and/or gas are delivered are not equally spaced.
Figure 11:
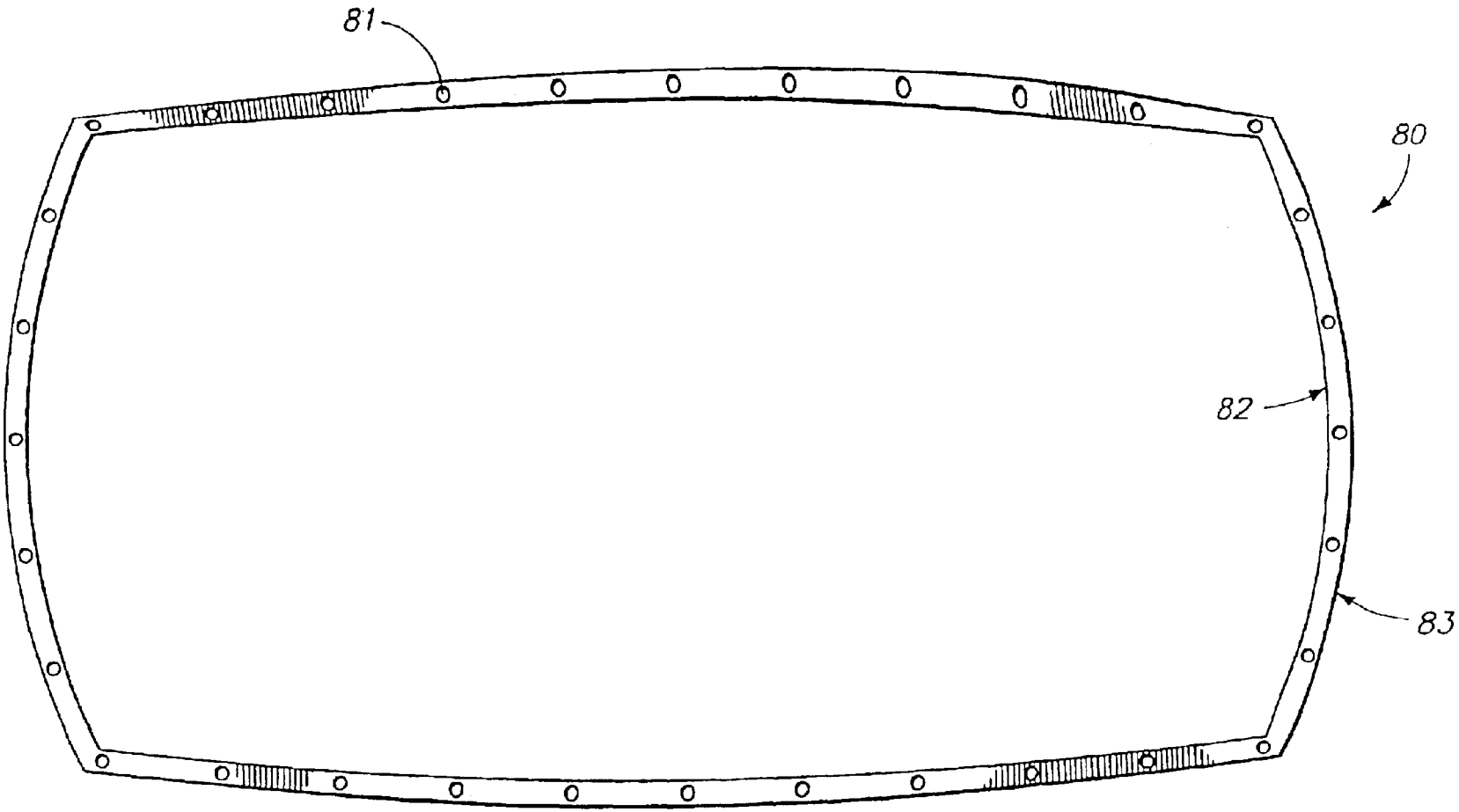
Figure 11:
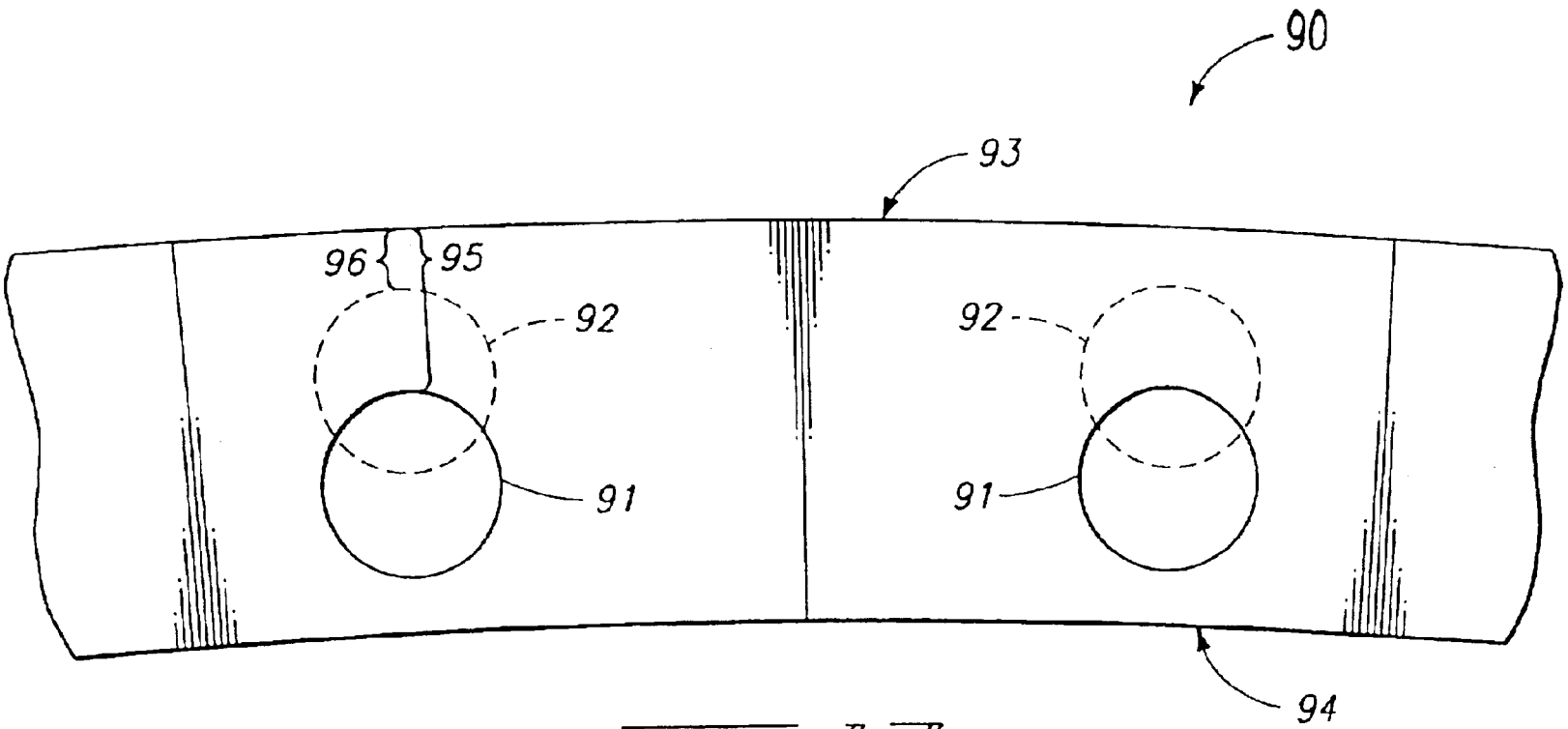

FIG. 10 is a top view of an alternative embodiment in which lubricant and/or gas are delivered to the perimeter wall through delivery holes 71 drilled from the top of the perimeter wall 70, only wherein the delivery holes 71 through which lubricant and/or gas are delivered are not equally spaced. The holes in region 74 are spaced closer together to achieve a higher flow of gas and/or lubricant in that region. An unequal distribution of the delivery holes 71 may be most advantageous in the lower portion of a horizontal casting mold apparatus to help counteract the effects of the weight of the solidifying metal.

Figure 11:
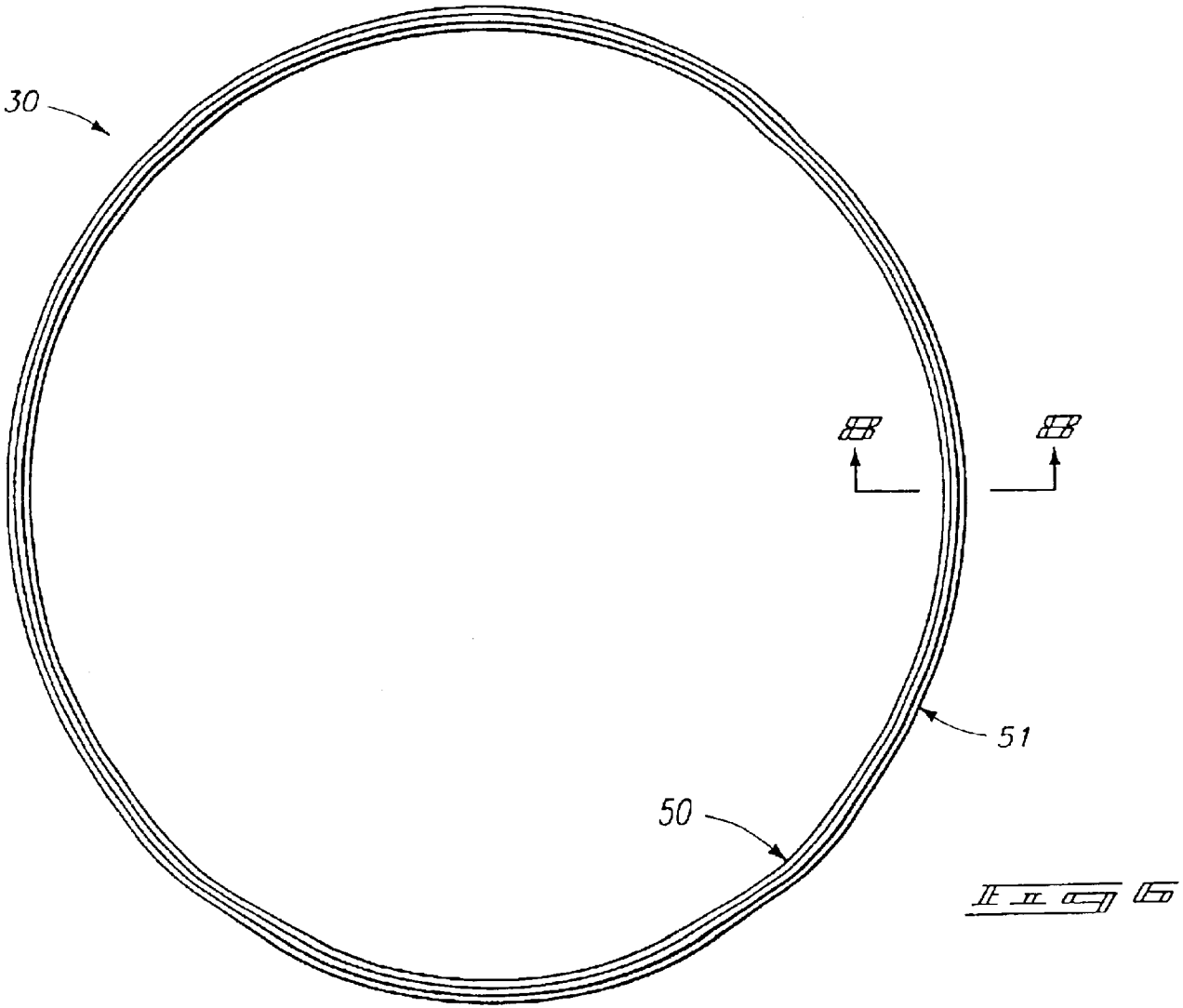
FIG. 11 is a top view of an alternative embodiment in which lubricant and/or gas are delivered to the perimeter wall through holes drilled from the top of the perimeter wall, and wherein shape of the perimeter wall is not circular.

FIG. 11 is a top view of an alternative embodiment in which lubricant and/or gas are delivered to the perimeter wall 80 through delivery holes 81 drilled from the top of the perimeter wall 80, and wherein the shape of the perimeter wall 80 is not circular. The shape of the solidifying metal from the mold shape shown in FIG. 11 is generally referred to as an ingot.

There are numerous other shapes, special shapes, and configurations that the perimeter wall of this invention may take, but are still within the meaning of the term perimeter wall as used herein.

FIG. 12 shows a section of a perimeter wall 90 within the contemplation of this invention, with an inner surface 93, an outer surface 94 and delivery holes 91. Delivery holes 91 are shown a distance 95 from the inner surface 93 of the perimeter wall 90. The distance 95 would be the delivery distance for those particular delivery holes 91. The dotted lines comprising a circle illustrate a second possible location for relocated delivery holes 92, which are a lesser second distance 96 from the outer surface of the perimeter wall 90. The second distance 96 would be the delivery distance for the relocated delivery holes 92.

In the example shown in FIGS. 9 through 12 wherein delivery holes are utilized, the surface area and consequently the flow rate, may be changed by changing the diameter or inner surface area of the delivery holes, by changing the length of the delivery holes, or by changing the spacing or number of delivery holes, or any combination of these factors. The delivery distance may be changed by changing the distance of the particular delivery hole to the inner surface of the perimeter wall.

The flow of lubricant and/or gas through a porous or permeable material is dependent on several different factors and therefore when the term correlating is used herein, it is meant in its broadest sense to mean the correlation to any factor or component which affects the flow of the lubricant and/or gas through the material chosen. This may mean the correlation to, without limitation: the cross-sectional area of where the lubricant and/or gas are delivered; the thickness of the material or media, i.e. how far the lubricant and/or gas must travel to get to the desired area; the density of the material or media; the porosity of the material or media; or the actual flow rate of the gas and/or lubricant.

If the flow rate were more two dimensional, it would tend to follow Darcey's law more closely, or be easier to apply Darcey's law to it. However, since the flow is necessarily three dimensional, predictions may be made from Darcey's law, but the flow will be generally more difficult to predict. Furthermore, in some applications, the lubricant and the gas may be mixed as it is delivered to the media, in which case the flow rate may further vary from or become less predictable from Darcey's law. The more variance there is from Darcey's law, the more that empirical data will need to be relied upon.

In a given application or mold table, it is desirable to maintain certain factors constant in each of the molds, such as: the lubricant and/or gas composition and viscosity; and the pressure differential of the lubricant and/or gas across the material or media.

The preferable way to alter the flow rate in the embodiments of this invention wherein the lubricant and/or gas is delivered to the perimeter walls through delivery holes drilled from the top of the perimeter walls, is to drill the delivery holes closer to the inner surface of the perimeter wall.

The preferable way to alter the flow rate in the embodiments of this invention wherein the lubricant and/or gas is delivered to the perimeter walls through delivery conduits on the outer wall of the perimeter wall, is to alter the depth of the delivery conduit, which consequently changes the delivery distance the lubricant and/or gas must travel to arrive at the desired location, i.e. the inner surface of the perimeter wall. This may increase the surface area of the material through which the lubricant and/or gas will flow, and/or decreases the thickness of the material or media through which it must flow to arrive at the desired location, i.e. the delivery distance.

In order to achieve the most accurate correlations for given shapes and material or media compositions, empirical data will need to be developed on an application by application basis. This is so even though a pre-determined density of the material or media is typically requested.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A permeable perimeter wall for a metal mold, comprising:

a perimeter wall body of permeable material extending around and defining a mold cavity, said body including an inner surface and an outer surface; and b. at least one delivery conduit adapted to supply a lubricant or gas under pressure to said perimeter wall body for diffusion into said mold cavity through said permeable material;

wherein said at least one delivery conduit is adapted to cause an unequal flow of said lubricant or gas into said mold cavity from different regions of said inner surface.

2. The perimeter wall according to claim 1, wherein said unequal flow is created by varying a surface area of said at least one delivery conduit in different regions of said perimeter wall body.

3. The perimeter wall according to claim 1, wherein said unequal flow is created by varying a delivery distance of said at least one delivery conduit from said inner surface in different regions of said perimeter wall body.

4. The perimeter wall of claim 1, wherein said at least one delivery conduit comprises a plurality of delivery holes extending through said perimeter wall body, and wherein said delivery holes are not equally spaced around said perimeter wall, thereby creating said unequal flow of said lubricant or gas into said mold cavity from said different regions of said inner surface.

5. The perimeter wall of claim 1, wherein said at least one delivery conduit comprises a plurality of delivery holes extending through said perimeter wall body, each delivery hole being spaced from said inner surface by a delivery distance, and wherein said delivery distance is greater in one region of said perimeter wall than another region thereof, thereby creating said unequal flow of said lubricant or gas into said mold cavity from said different regions of said inner surface.

6. The perimeter wall of claim 1, wherein said at least one delivery conduit comprises a plurality of delivery holes extending through said perimeter wall body, each delivery hole having an internal surface area, and wherein said delivery holes in one region of said body have internal surface areas that differ from internal surface areas of said delivery holes in another region of said body, thereby creating said unequal flow of said lubricant or gas into said mold cavity from said different regions of said inner surface.

7. The perimeter wall of claim 1, wherein said at least one delivery conduit comprises a plurality of delivery holes extending through said perimeter wall body, each delivery hole having a length within said body, and wherein said delivery holes in one region of said body have lengths that differ from lengths of said delivery holes in another region of said body, thereby creating said unequal flow of said lubricant or gas into said mold cavity from said different regions of said inner surface.

8. The perimeter wall of claims 1, wherein said at least one delivery conduit comprises a delivery hole within said perimeter wall body spaced both from said inner and outer surfaces of said body.

9. The perimeter wall of claim 1, wherein said at least one delivery conduit comprises a circumferential groove in said outer surface of said perimeter wall body.

10. The perimeter wall of claim 1, wherein the permeability of said permeable material varies in different regions of said perimeter wall body, and wherein said flow of lubricant or gas from said inner surface in said different regions is pre-determined by correlating a property of said at least one delivery conduit to the estimated flow rate of lubricant or gas through said perimeter wall in said different regions, wherein said property of said at least one delivery conduit is selected from the group consisting of surface area of said at least one delivery conduit and distance of separation of said at least one delivery conduit from said inner surface of said perimeter wall body.

11. The perimeter wall of claim 1, wherein said at least one delivery conduit comprises a delivery conduit for lubricant and a delivery conduit for gas.

12. An assembly of a mold housing and a permeable perimeter wall of a metal mold cavity, comprising:

a. a perimeter wall body of permeable material extending around and defining said mold cavity, said body including an inner surface and an outer surface;

b. a mold housing having a wall abutting said outer surface of said perimeter wall body; and c. at least one delivery conduit in said abutting wall of said mold housing adapted to supply a lubricant or gas under pressure to said outer surface of said perimeter wall body for diffusion into said mold cavity through said permeable material;

wherein said at least one delivery conduit is adapted to cause an unequal flow of said lubricant or gas into said mold cavity from different regions of said inner surface.

13. The assembly of claim 12, wherein said at least one delivery conduit comprises a delivery conduit for lubricant and a delivery for gas.

14. A mold table assembly for the continuous casting of metal, comprising:

a plurality of casting molds attached to a casting mold table, each casting mold including:

i. a perimeter wall comprising a perimeter wall body of permeable material extending around and defining a mold cavity and having an inner surface and an outer surface;

ii. a mold housing having a wall abutting said outer surface of said perimeter wall body; and iii. at least one delivery conduit adapted to supply a lubricant or gas under pressure to said perimeter wall body for diffusion into said mold cavity through said permeable material;

wherein said at least one delivery conduit is adapted to cause an unequal flow of said lubricant or gas into said mold cavity from different regions of said inner surface.

15. A process of providing a permeable perimeter wall for a metal mold, comprising:

a. providing a perimeter wall body of permeable material extending around and defining a mold cavity, said body including an inner surface and an outer surface;

b. providing at least one delivery conduit adapted to supply a lubricant or gas under pressure to said perimeter wall body for diffusion into said mold cavity through said permeable material; and c. adapting said at least one delivery conduit to cause an unequal flow of said lubricant or gas into said mold cavity from different regions of said inner surface.

16. A process of continuously casting a molten metal, comprising:

a. providing a perimeter wall body of permeable material extending around and defining a mold cavity, said body including an inner surface and an outer surface;

b. providing at least one delivery conduit adapted to supply a lubricant or gas under pressure to said perimeter wall body for diffusion into said mold cavity through said permeable material, wherein said at least one delivery conduit is adapted to cause an unequal flow of said lubricant or gas into said mold cavity from different regions of said inner surface; and c. casting metal in the mold cavity while supplying said unequal flow of lubricant or gas to said inner surface.

* * * * *

UNITED STATES PATENT AND TRADEMARK OFFICE

CERTIFICATE OF CORRECTION

PATENT NO. : 6,808,009 B2
APPLICATION NO. : 10/461631
DATED : October 26, 2004
INVENTOR(S) : Michael K. Anderson It is certified that error appears in the above-identified patent and that said Letters Patent is hereby corrected as shown below:

Cover page, item (62), "Division of application No. 09/620,110, filed on Jul. 20, 1997," should read --Division of application No. 09/620,110, filed on Jul. 20, 2000,--.

Column 1, line 8, "Jul. 20, 1997" should read --Jul. 20, 2000--.

Signed and Sealed this

Eighteenth Day of September, 2007

JON W. DUDAS
*Director of the United States Patent and Trademark Office*